United States Patent [19]

Beall

[11] Patent Number: 4,663,860

[45] Date of Patent: May 12, 1987

[54] VERTICAL PROGRESSIVE LUMBER DRYER

[75] Inventor: Frank C. Beall, Puyallup, Wash.

[73] Assignee: Weyerhaeuser Company, Tacoma, Wash.

[21] Appl. No.: 581,942

[22] Filed: Feb. 21, 1984

[51] Int. Cl.[4] ..... F26B 3/04; F26B 3/14

[52] U.S. Cl. ..... 34/13.4; 34/13.8; 34/35; 34/38; 34/66; 34/86; 34/149; 34/216; 34/217; 34/236; 34/239

[58] Field of Search ..... 34/13.4, 13.8, 20, 22, 34/26, 30, 35, 38, 66, 86, 212, 216, 217, 236, 237, 238, 239, 149

[56] References Cited

U.S. PATENT DOCUMENTS

| | | | |
|---|---|---|---|
| 15,316 | 3/1922 | Weiss | 34/13.4 |
| 1,855,401 | 4/1932 | Leonard | 34/86 |
| 2,369,879 | 2/1945 | Worth et al. | 34/86 |
| 3,470,623 | 10/1969 | Hildebrand | 34/66 |
| 3,680,219 | 8/1972 | Koch | 34/13.4 |
| 4,106,215 | 8/1978 | Rosen | 34/13.8 |
| 4,182,048 | 1/1980 | Wolfe et al. | 34/13.4 |
| 4,261,110 | 4/1981 | Northway et al. | 34/13.4 |

*Primary Examiner*—Albert J. Makay
*Assistant Examiner*—David W. Westphal

[57] ABSTRACT

A vertical progressive lumber dryer has a plurality of vertically spaced functional zones through which lumber formed into units pass. Each unit rests atop a base and each layer of boards in the stack is separated by sticker means. Predetermined appropriate operating conditions are selected for the drying medium as well as other parts of the process. After a car has completed the last step within the dryer, it is removed and the dryed lumber sent for further processing.

19 Claims, 3 Drawing Figures

VERTICAL PROGRESSIVE LUMBER DRYER

BACKGROUND OF THE INVENTION

The field is lumber drying and handling. More particularly, the present invention relates to a vertical-progressive, convective drying process for lumber. In lumber manufacture, green lumber is produced from logs of fixed or multiple lengths. Lumber is then stacked on cars in which each layer is separated by stickers. Cars of lumber are queued for horizontal movement into the dry kilns in a batch process.

Conventional lumber drying systems presently used in lumber mills are typically batch, convective dry kilns. The green lumber, having a green moisture content of anywhere from 30 to 250%, is stacked on individual cars with stickers to separate courses or layers of lumber. These cars are moved into the dry kilns, the doors closed, and exposed to a drying schedule. Hot air is moved horizontally across the lumber, transferring heat to the boards and providing for removal of the moisture. Typically, schedules are used to dry in the shortest possible time with minimal degrade losses from warp. The final moisture content target is consistent with grading or customer requirements, which for softwoods is about 10 to 20% moisture content.

Because of the variability in moisture content and growth properties of green lumber, and the stress development and differential shrinkage that occurs during the typical drying process, many of the above-mentioned desirable characteristics are not consistently obtained. For example, conventionally dried lumber usually has a range of moisture content within the load after drying and a certain percentage of the lumber must be either redried to reduce the moisture content to the required level or sold at a lower grade. In addition, as moisture content is lowered, warpage occurs which reduces the lumber value. This warpage also interferes with further processing steps, such as planing, where machine downtime from lumber breaks can be excessive. Much of the volume of excessively wet lumber or overdried lumber is caused by poor endpoint control in drying. Present state-of-the-art time schedules to establish the drying endpoint. It is well known that a typical means of reducing wet lumber is to overdry it, increasing the amount of warp.

In existing dry kilns, a considerable amount of energy is required per unit volume of dried lumber, and represents a substantial portion of the energy required in a lumber mill. A significant amount of the drying energy is wasted because of the inability to economically recover energy from exhaust air. It is also a recognized problem that stacking and baffling of lumber loads causes inefficient airflow of the heated air leading to longer drying times and poor moisture content uniformity. Several types of drying systems have been developed to overcome the above deficiencies. For example, restraint systems, such as dead loads of concrete, have been used to reduce warpage during drying. While this is effective, it is costly to implement, displaces kiln volume, can cause safety problems, and increases energy losses.

Progressive kilns have been developed to reduce energy and labor costs. However, these kilns are not efficient in air movement and may require excessively long drying times. A vertical continuous kiln has been designed which eliminates the need for restraints in that the lumber is self-restrained and increases energy efficiency in the airflow pattern. As an example of such a kiln and to supplement the disclosure herein, the U.S. patent to Northway et al—U.S. Pat. No.4,261,110 issued Apr. 14, 1981—is incorporated herein by reference. Unfortunately, the complex lumber course removal mechanism disclosed in the patent requires nearly perfect stacking to prevent jamming of the mechanism and board damage. It also uses individual stickers which increase handling and stacking problems. In addition, the air reversal points are not well separated, which will cause excessive air leakage from one zone to another and subsequent poor moisture content uniformity. The continuous dryer is not well designed for endpoint moisture content measurement and determination since dried lumber exits only in single or several courses at a given time.

SUMMARY OF THE INVENTION

Briefly stated, the claimed invention is practiced in one form by an improved method for the drying of green lumber in a vertical progressive dryer. The method steps include movement of a car of green lumber of between 30 and 250% moisture content onto the vertical stack, incrementing the car downward through a sequence of heating zones, being exposed to a final cooling zone, and exiting the drying to the unstacker.

DESCRIPTION OF THE PREFERRED EMBODIMENT

Figure 1:
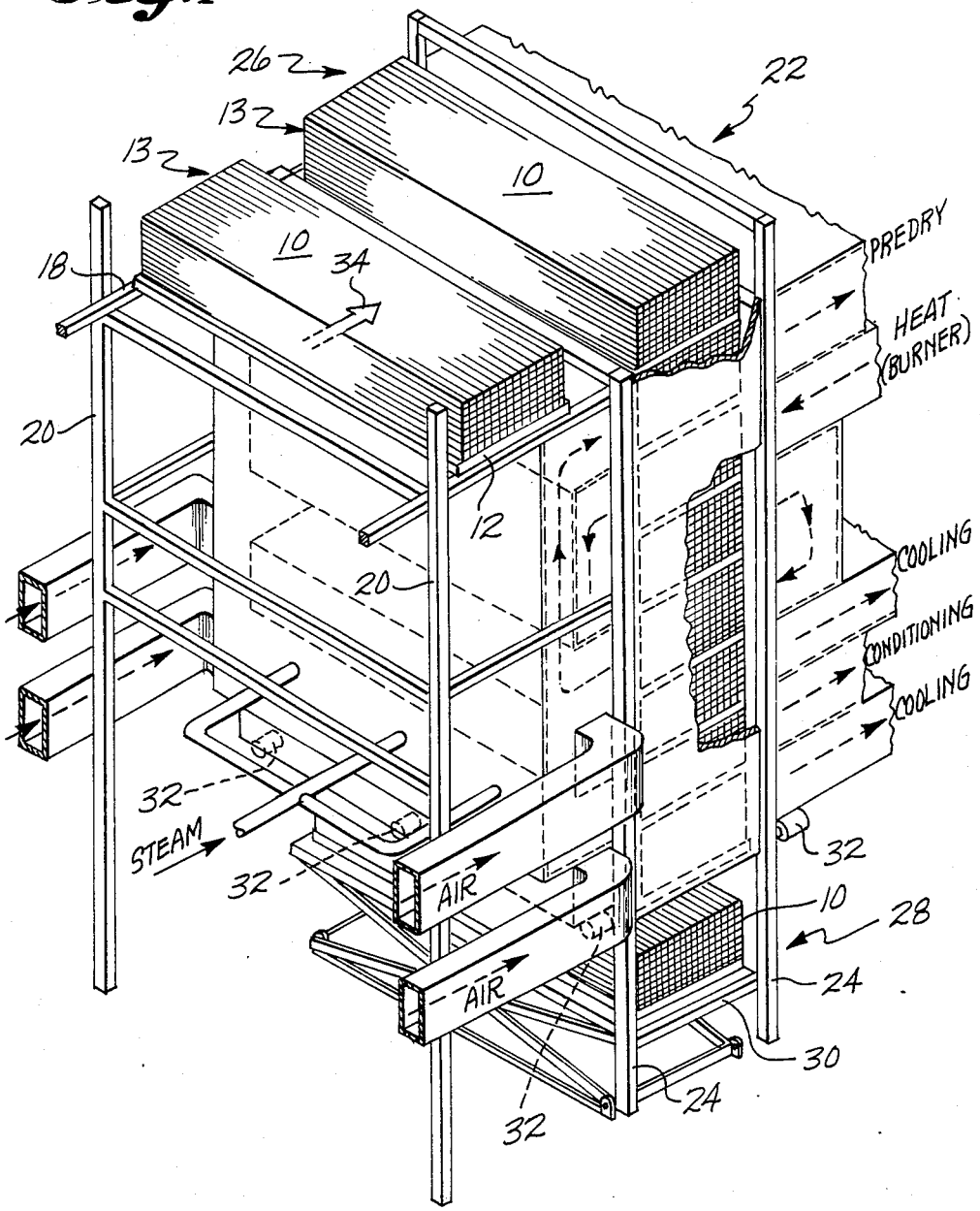
FIG. 1 is an isometric view showing the vertical progressive dryer of the present invention.
Figure 2:
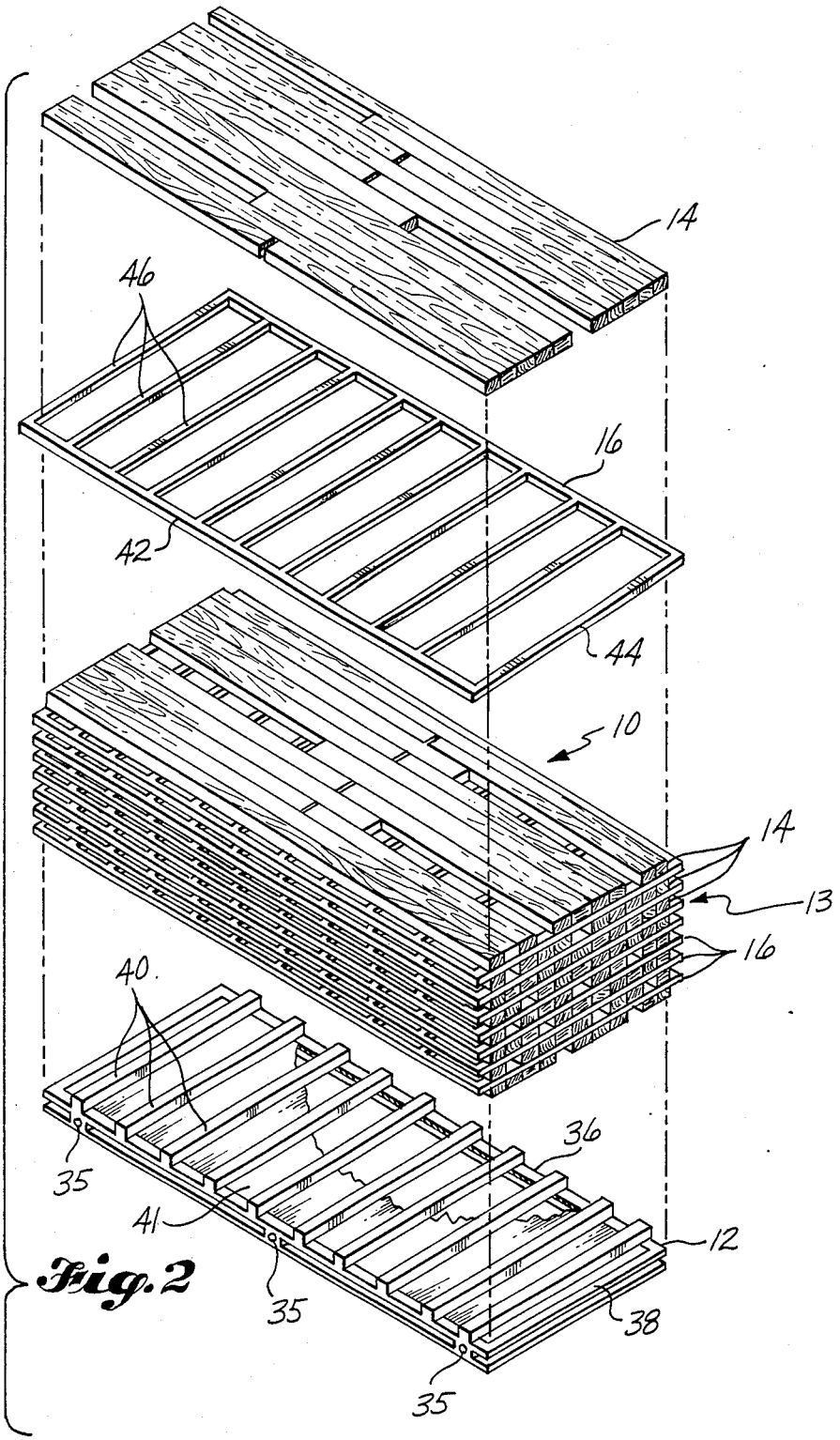
FIG. 2 is an exploded isometric view showing a car comprised of a unit of lumber and the support base.

Referring to the FIGS. 1 and 2, a lumber drying system is shown that has a high drying capacity and will be suitable for fixed or random length lumber. In the smplest configuration for random length lumber, the lumber is box-piled into the units 10 to obtain the best dryer coverage. As will be well understood by those skilled in the art, the internal length of dryers can also be matched to specific lumber lengths or combination of lengths. The lumber is stacked into a unit upstream prior to entrance to the dryer and placed atop a base 12 with the combination being known as a car, each of which is indicated generally as 13. The height and width of units 10 are fixed dimensions which can be selected according to the needed process design or throughput. Lumber is stacked in courses or layers 14, separated by individual separating means. In an improved design, a sticker frame 16 is used in place of traditional individual stickers. The frame assembly eliminates the handling of individual stickers, minimizes stacking problems, and permits improved airflow movement. Each unit 10 is built on a base 12 in a similar manner to batch stacking. The lumber may be box-piled or stacked in fixed lengths depending on the process design.

Supporting the incoming units 10 is an infeed bed 18 atop which the bases 12 are movable. The bed 18 is supported at the proper elevation by vertically extending supports 20. The vertical progressive dryer is generally indicated at 22 and has a plurality of functional zones within the dryer, each of which will be fully described later. Structurally, dryer 22 is comprised of vertical support posts 24 spaced in an orientation to form a volume that will accommodate the length and width of cars 13 that will be introduced. The vertical height of posts 24 must accommodate an infeed station 26 atop the dryer 22, the plurality of functional zones, and an outfeed station 28 at the bottom. Each vertical zone including the infeed and outfeed stations will have a vertical dimension substantially equal to the vertical height of the cars 13. Cars 13 will, in a typical dryer application, lie on the order of 1–2 m in height comprising 15–30 layers of lumber plus the thickness of base 12 and sticker frames 16 making up each unit of lumber.

The volume within dryer 22 is surrounded by typical dryer wall construction which is insulated sheet metal and designed to minimize corrosion. On each long side of the dryer the wall construction is in duct form to allow for fluid flow as will be described. On either end of dryer 22, the walls close off the interior to confine the various flows. Dryer 22 is open at the top and bottom to, of course, allow for travel of the cars of lumber into, through, and out of the dryer.

Serving to support and transport the cars of lumber through dryer 22 in a predetermined progressive manner are the unloading platform 30 and unloading latches 32. Before the first unit enters the dryer, the unloading platform 30 will be used to add dunnage from the top or bottom, such as sticker frames and support bases, to fill the dryer. As a first car enters infeed station 26 from the side as indicated by directional arrow 34, the bottom of the base 12 will be supported atop the added dunnage, which will be properly positioned for the arriving car. Once the cars are moved into position at infeed station 26, they will then begin to move vertically downward through the dryer supported within each successive zone by the dunnage and also by the next lower car of lumber. By providing the vertical restraining force distributed substantially uniformly over the top layer of boards on the next lower car, very little, if any, warpage will occur throughout the drying process. At the outfeed station 28 to remove a car 13, the unloading platform 30 is raised to make contact with the bottom of the lowermost base, the unloading latches 32 are released and the unloading platform 30 will remove the car of dry lumber for further processing such as unstacking and then surfacing. The entire contents of dryer 22 will move downwardly and the latches 32 will then be inserted in receptacles 35 of the next base 12. In this manner, the cars 13 are indexed sequentially through the dryer zones.

Looking now specifically at FIG. 2 the specially prepared unit of lumber is depicted. Each unit 10 is formed atop a base 12 in a manner where the sides and ends of the unit are slightly recessed with respect to the structural-side members 36 and end members 38 of base 12. The bottom layer of lumber will rest atop a plurality of cross members 40 which are fixed to the top edge of side members 36. A sheet metal web 41 closes the bottom of base 12. Between layers of lumber in a unit 10 are the sticker frames 16. Each sticker frame is comprised of a rectangular frame with sticker frame side members 42 and end members 44. Cross members 46 are spaced down the length of frame 16. The sticker frame end members 44 will be oriented so as to be substantially flush with the ends of a unit 10, while side members 42 will be spaced outwardly from the sides of a unit 10 to allow for fluid flow across the layers of lumber, as will become apparent. As an example of certain appropriate dimensions for sticker frames 16, the members can be 30 mm in square cross section and the side members can be spaced from the edge of the lumber stacks approximately 50 mm. The base 12 would typically be 100 mm deep and the receptacles 35 for receiving the latches 32 will conveniently be positioned along the side members 36 of base 12.

Figure 3:
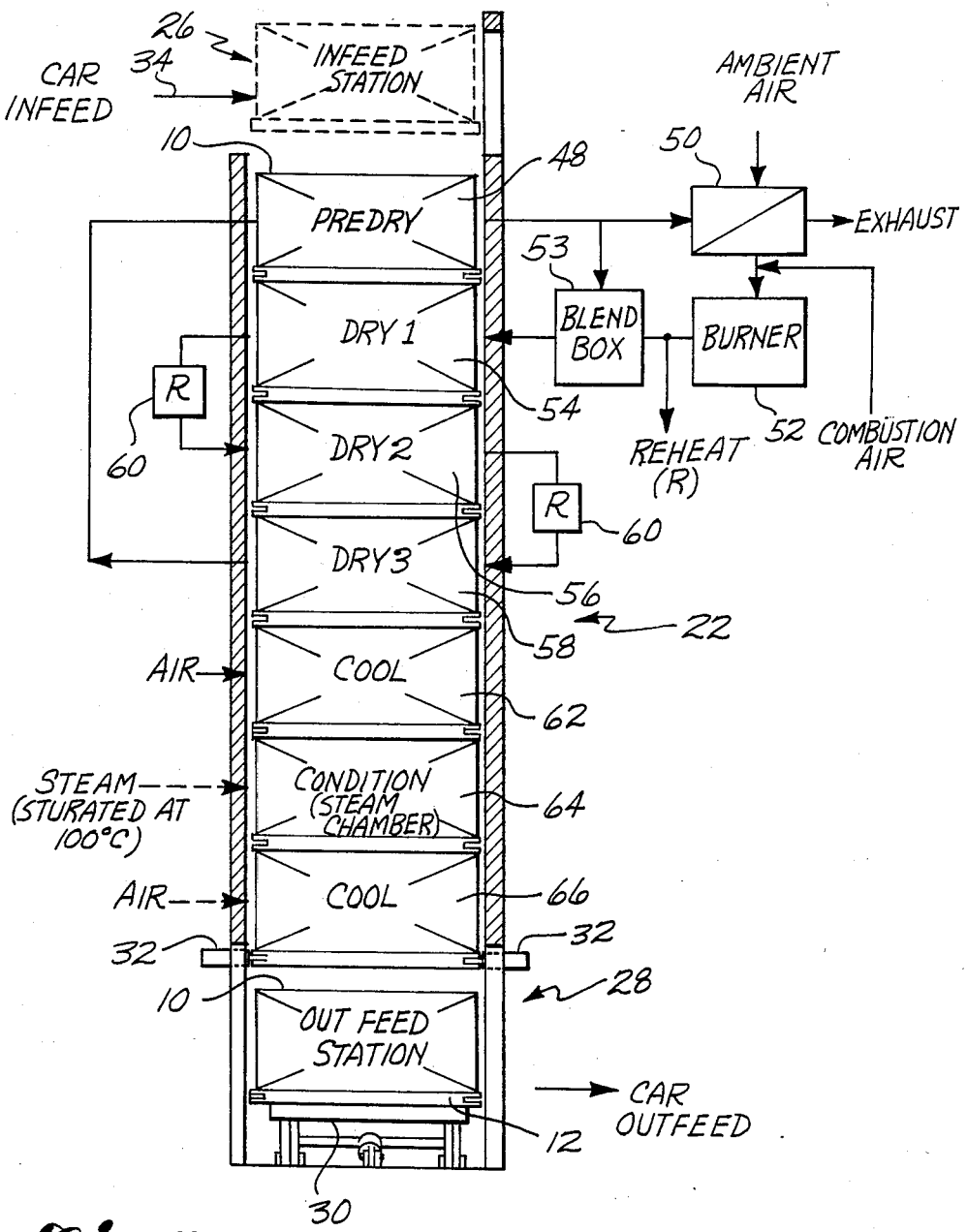
FIG. 3 is a schematic representation showing the sequential zones within the dryer.

Turning now to a description of the drying process and fluid flow, FIGS. 1 and 3 illustrate the structure necessary to provide the appropriate fluid ducting and the flow patterns and constituent fluid flows for the drying process. Just below infeed station 26 is a predrying zone 48 where exhausted hot air (one appropriate well known drying medium) from selected drying zones is directed laterally through the layers of lumber forming the unit 10 within predrying zone 48. Within the predrying zone 48 the lumber temperature is increased as the flowing air transfers energy to the lumber. If desired, the cold air exhausted from predrying zone 48 can pass through a heat exchanger 50 external to the dryer where any residual energy can be used to preheat air flowing into the burner station indicated at 52. A portion of the exhaust air from predrying zone 48 can also be recycled by blending with hot gases from the burner in the blend box 53.

Directly below predrying zone 48 are three vertically in-line drying zones indicated at 54, 56 and 58. Each zone is sized to accommodate one car of lumber and more or less drying zones may be used depending upon throughput and drying parameters; however, at least one drying zone must be provided. At burner station 52 (comprised of any suitable well-known fluid heating means such as a typical gas-fired burner), the fluid that will be used, such as air, will be heated to the appropriate temperature and relative humidity. The temperature for use in the first drying zone may appropriately be from 200°–220° C. The heated fluid (air) is then ducted to flow laterally across the layers of lumber within each unit within its particular drying zone 54, 56 or 58. Typical reheaters 60 may be provided to keep the temperature of the fluid at the desired level. As previously pointed out, a portion of the exhaust air from certain drying zones can be directed through the preheating zone and in the embodiment depicted, it is from the third drying zone 58.

Directly below the last drying zone is cooling zone 62 where, after the lumber in unit 10 reaches certain predetermined conditions, ambient air is directed over the layers of lumber located in cooling zone 62. At cooling zone 62 the cool air captures some of the energy in the hot lumber thereby cooling it to a predetermined level. The exhaust air from cooling zone 62 can be ducted to heat exchanger 50 if it can be justified based on an economic energy balancing calculation.

If desired, a conditioning zone 64 may be located directly below cooling station 62. Saturated steam typically at 100° C. may be directed over the layers of lumber within the unit then located in conditioning zone 64 in order to alter lumber properties such as uniformity of moisture content. In addition, if desired, a second cooling zone 66 can be located directly below conditioning zone 64 where cool air can be directed over the lumber to bring down the temperature to a final predetermined level. Once the final conditions are reached for the lumber the unloading platform supporting the bottommost car, whether it is located in cooling station 62, conditioning zone 64, or second cooling zone 66, is activated and the car is removed from dryer 22 and transported for further processing.

Since the lumber, as it progressively passes through the dryer will always be restrained vertically, little warpage will occur and, since the process is continuous, the drying times will be rapid and lumber handling problems reduced. After the lumber exits the dryer, the lumber will typically be unstacked and the bases and sticker frames returned to the upstream stacking station (not shown) for reuse.

Vertical movement through the dryer can be controlled by a time-temperature schedule as will be well understood by those skilled in the art. In an improved design, the moisture content of the stack in the bottom drying zone can be measured to determine the proper time for it to be moved to the cooling zone. One means of moisture measurement uses the sticker frames as electrodes which match with the appropriate contacts for signal processing. The throughput sequence can be balanced by adjusting drying temperatures in the initial zones. Each base 12 functions to baffle the airflow sections of the dryer to minimize leakage. The bases 12 also serve to maintain horizontal alignment of the lumber within the dryer.

EXAMPLE 1

A computer program was run to simulate typical conditions which boards might be exposed to in the vertical progressive dryer of the present invention.

Courses were made up with 18 boards having dimensions of 42 mm thick, 102 mm wide and 3 m long. The number of courses per unit and board length are unimportant in the simulation. Sticker frame thickness was 25 mm. The initial wood conditions were 100% moisture content (ovendry basis), 20° C. wood temperature, and 500 kg/m$^3$ wood density.

In this example, the drying zones had the following conditions:

| | Inlet Temp. (°C.) | Outlet Temp. (°C.) | Outlet Moisture Content (%) |
|---|---|---|---|
| Predry | 135 | 110 | 80 |
| Dry 1 | 200 | 155 | 38 |
| Dry 2 | 180 | 145 | 15 |
| Dry 3 | 145 | 135 | 7 |

Air velocity was 15 m/s at 200° C. and the air was reheated only once, between the first and second drying zones. Drying time within each zone was one hour. Air reversal occurred between drying zones.

EXAMPLE 2

The conditions were the same as in Example 1, except the sequence of drying was changed to eliminate the predrying zone, a fourth drying zone was added, and the reheating steps were eliminated. Air velocity was 15 m/s at 220° C., drying time within each zone was one hour, and air reversal occurred between each zone.

In this example, the drying zones had the following conditions:

| | Inlet Temp. (°C.) | Outlet Temp. (°C.) | Outlet Moisture Content (%) |
|---|---|---|---|
| Dry 1 | 220 | 173 | 50 |
| Dry 2 | 173 | 147 | 27 |
| Dry 3 | 147 | 135 | 17 |
| Dry 4 | 135 | 130 | 12 |

These examples suggest that the vertical progressive dryer of the present invention can dry lumber quickly, efficiently and without handling problems.

While a detailed description of the invention has been disclosed together with the best mode, various changes and modifications may occur to those skilled in the art. All such changes and modifications are intended to be included within the scope of the following claims.

I claim:

1. The method of drying wet wood in a vertical progressive dryer having a plurality of drying stations comprising the steps of:

forming a plurality of units of wet wood in which each unit is comprised of a plurality of vertically stacked layers of wet wood extending upwardly from a closed base and with each layer separated by separating means, successively feeding so formed units of wood to an infeed station which is vertically spaced upwardly from a plurality of vertically stacked drying stations each of which holds one unit of wet wood and through which each unit of wood passes in its downward flow through the dryer with the unit above a lower unit having its base resting atop the upper surface of the lower unit when the dryer is filled with units of wood thereby providing restraining forces to reduce warpage, drying the units of wood to a predetermined level within the drying stations while each unit of wood is substantially vertically sealed by the closed base when the unit is in its respective drying station, and successively removing a dried unit of wood from the lowermost drying station after it has reached the predetermined level of dryness.

2. The method of claim 1 including the use of exhaust gas from at least one drying station to predry a unit of wood in a predry station above the first drying station.

3. The method of claim 1 in which the unit of wood removed from the lowermost drying station is sequenced downwardly into a cooling station.

4. The method of claim 3 in which the unit of wood moved into the cooling station is then sequenced downwardly, first into a conditioning station and then into another cooling station.

5. The method of claim 4 in which the conditioning in the conditioning station is carried out by the use of saturated steam and the cooling in the subsequent cooling station is carried out by the use of cool gas.

6. The method of claim 3 in which the cooling in the cooling station is carried out by the use of cool gas.

7. The method of claim 1 in which the drying is carried out by the use of hot gas.

8. The method of claim 1 in which the removal of each unit of dried wood from the dryer is carried out by removing the holding means serving to hold the stack of units in the dryer from the lowermost unit, moving the entire stack of units down by one unit and reapplying the holding means to the next unit above the one just removed.

9. A vertical progressive dryer open at the top and bottom for drying vertically stacked units of wood as they are transported progressively through a plurality of vertically spaced drying stations and out of the dryer, comprising:

means for substantially vertically sealing each unit in its respective drying station, an infeed station spaced upwardly above the drying stations having means for accepting and aligning an incoming unit of wet wood with the first station below the infeed station, means for filling the plurality of vertically spaced drying stations with units of wet wood, means for progressively drying the units of wood as they progress downwardly through successive drying stations, and means for removing the unit of wood from the lowermost station by moving the units of wood downwardly, each into the next lower station, releasing the unit moved downward past the open bottom and then holding the remaining units in the dryer for some predetermined time.

10. The dryer of claim 9 in which each unit of wood is stacked vertically on a closed base member which is the means for substantially vertically sealing and which has plan dimensions slightly less than the dimensions of the cross sectional area of the drying stations.

11. The dryer of claim 10 in which a closed base member includes sides, ends, and a plurality of cross members extending between the sides and fixed to the top edges thereof together with a web closing the bottom.

12. The dryer of claim 11 further including a plurality of receptacles spaced along the outside edge of a base member.

13. The dryer of claim 9 in which the means for holding the remaining units in the dryer includes retractable latches on the dryer for engagement with the receptacles on the lowermost closed base then residing in the dryer.

14. The dryer of claim 9 further including a predry station above the first drying station.

15. The dryer of claim 9 further including a cooling station below the lowermost drying station.

16. The dryer of claim 15 further including a conditioning station and another cooling station below the first cooling station.

17. The dryer of claim 9 further including separating means for separating each layer of wood within a unit from its adjacent layer.

18. The dryer of claim 17 in which a separating means includes a substantially rectangular frame with sides, ends, and a plurality of cross members extending between the sides.

19. The dryer of claim 9 further including means for measuring the moisture content of a preselected portion of the wood within the dryer to, in part, control the progressive drying.

* * * * *